US005282285A

United States Patent [19]

de Gelis et al.

[11] Patent Number: 5,282,285

[45] Date of Patent: Feb. 1, 1994

[54] BED BASE

[76] Inventors: Alain de Gelis, 13 Boulevard du Roi-Arthur, Pace, France, F-35740; Christian de Gelis, Colliers, Muides-sur-Loire, France, F-41500

[21] Appl. No.: 866,788

[22] Filed: Feb. 27, 1992

[51] Int. Cl.[5] ..... A47C 23/06

[52] U.S. Cl. ..... 5/237; 5/238; 5/242

[58] Field of Search ..... 5/236.1, 237, 238, 241, 5/242, 244, 239, 470, 191; 267/165

[56] References Cited

U.S. PATENT DOCUMENTS

| | | | |
|---|---|---|---|
| 54,737 | 5/1866 | Jones | 5/239 |
| 87,184 | 2/1869 | Mattson | 5/237 |
| 1,096,333 | 5/1914 | Warner | 5/244 |
| 2,349,839 | 5/1944 | Apicella | 5/237 |
| 2,371,777 | 3/1945 | Retter | 5/236.1 |
| 2,414,978 | 1/1947 | Richardson | 5/191 X |
| 4,222,134 | 9/1980 | Degen | 5/238 X |
| 4,567,615 | 2/1986 | Fanti | 5/237 X |
| 4,638,517 | 1/1987 | Yang et al. | 5/238 X |

FOREIGN PATENT DOCUMENTS

| | | | |
|---|---|---|---|
| 72951/87 | 5/1987 | Australia . | |
| 0150873 | 8/1985 | European Pat. Off. . | |
| 3834542 | 6/1989 | Fed. Rep. of Germany | 5/238 |
| 8809806 | 8/1989 | Fed. Rep. of Germany . | |
| 782792 | 6/1935 | France . | |
| 2196134 | 3/1974 | France . | |
| 379712 | 8/1964 | Switzerland . | |

*Primary Examiner*—Michael F. Trettel
*Attorney, Agent, or Firm*—Darby & Darby

[57] ABSTRACT

A slatted bed base comprising a series of units (13) each of which includes an upper slat (3) on a lower support (5) mounted on a rigid, central and longitudinal beam (7) which is fixed in relation to the floor. The lower support (5) and the upper slat (3) are connected by a flexible linking element (14) allowing relative movement between the support (5) and the slat (3). The units (13) are spaced apart so that they can move independently of each other.

12 Claims, 3 Drawing Sheets

FIG.1
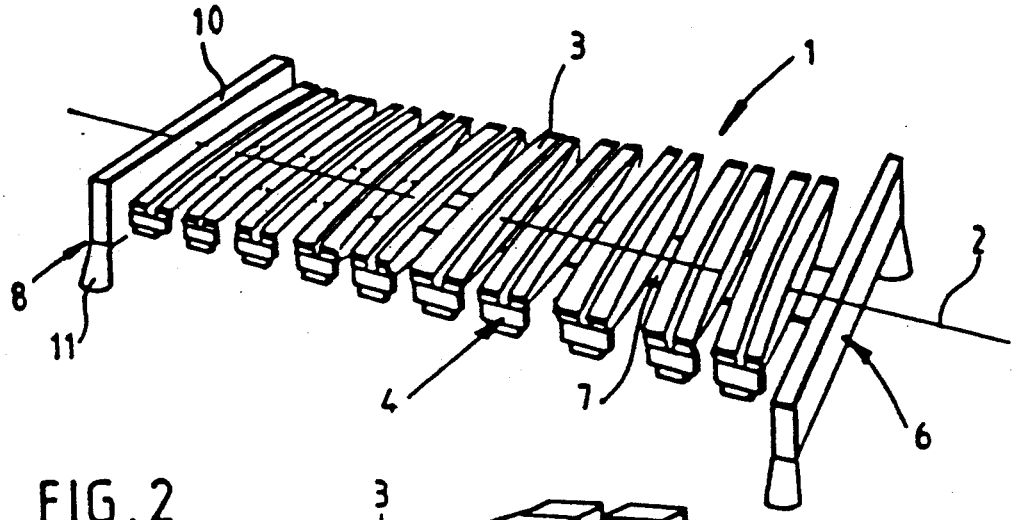
FIG.2
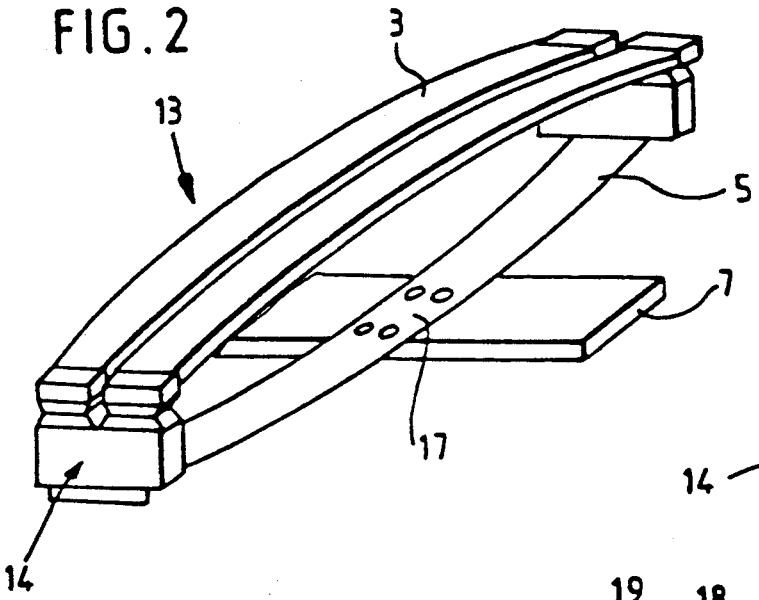
FIG.4
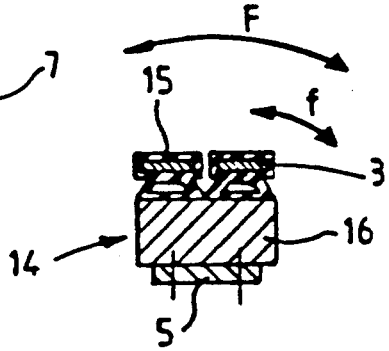
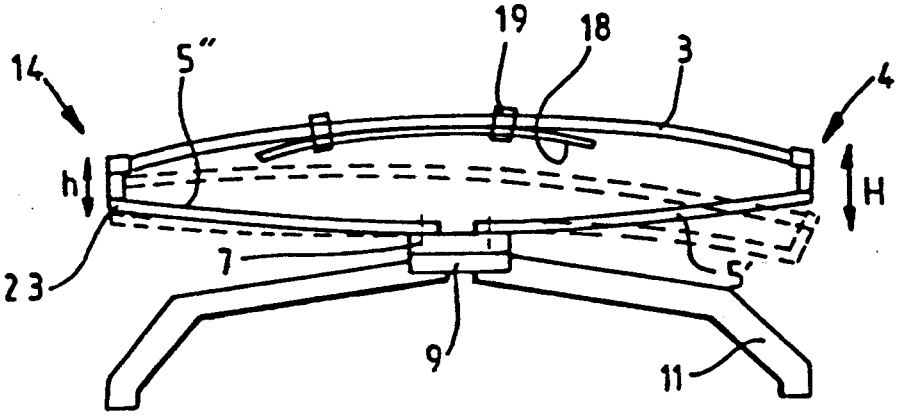
FIG.3

BED BASE

BACKGROUND OF THE INVENTION

The present invention relates to a bed base.

A bed base is a flexible part of a bed which rests in the bed frame or on legs (couches, settees, etc.) and on which the mattress lies.

Known are spring bed bases, formed by a wooden box with rigid cross bars fitted with springs and covered with fabric and metal bed bases with stretched wire gauze or netting. Known further are slat bed bases. These have a series of flexible slats, generally consisting of several thin slats of beech wood. At their ends the slats are fastened on a rigid frame, and they are often arched upward to increase the course of flexibility.

Bed bases with slat offer the advantage over spring bed bases of having a longer life. That is, springs become slack, while slats keep their quality.

However, slat bed bases, like the metal bed bases, have the disadvantage of showing a more or less great stiffness when one approaches the frame or the wooden box. That is, the slats, like the wire netting, are fastened on a wooden or metal frame, and it is owing to this fastening of their end on this immobile frame that said slats and said netting can acquire the desired elasticity. But it is the center of the slatted surface or of the gauze and not their edges that is elastic. This mechanical necessity therefore is a disadvantage since the bed base is soft at the end and pleasant only at its center.

Bed bases with slats have been made whose ends are mounted on the frame by means of springs. Such bed bases are described notably in EP-A-1,050,873, CH-A-399,712. However, on the one hand the presence of a frame to which the slats are fastened further limits the freedom of movement of the slats, and on the other hand the springs are of spring type metal or equivalent which limits their life.

Also there has been realized in U.S. Pat. No. 2,349,839 a bed base with slats the ends of which can be displaced vertically without being mechanically connected by a spring mounted on a frame. It is formed by units ("modules") composed of an upper horizontal slat rigidly mounted on a lower arched slat. The units are joined together on the one hand by a lower central beam on which they rest and on the other hand by three upper horizontal slats. However, the construction of this bed base does not permit obtaining satisfactory deformations because of the rigidity of the connections. This arrangement forms practically undeformable cylinder portion which can oscillate only very slightly around the beam.

BRIEF DESCRIPTION OF THE INVENTION

It is the objective of the present invention to resolve the above shortcomings, and its subject is a slatted bed base of the kind having a succession of units, each having at the top a slat carried by a lower support mounted on a longitudinal central rigid beam, fixed relative to the floor. The lower support and the upper slat are connected by a flexible linking element to permit relative movements of the elements with one another, and the units are separated from each other so that their movements are independent.

The bed base according to the invention has the following characteristics:

the unit has several identical upper slats to one lower support;

the linking element, or satellite, has an undeformable rigid piece, on which is mounted a ferrule or swivel joint, of rubber, intended to receive and slidingly hold the slat or slats, and under which the end of the support is screwed.

the spread of the lower support is smaller than that of the upper slat or slats and the ferrule of the linking element goes through like a pin or equivalent, intended to receive and hold the upper slat while permitting the relative displacement of the slat on the support.

the lower support has two undeformable rigid arms mounted pivoting on the beam around a horizontal arc, and each equipped with a spring or equivalent which raises the arms upward.

the lower support has opposite arms which extend laterally.

the upper slat is a wire gauze or netting.

The beam is of variable width, and the end of the arms describes a straight edge in such a way that the arms which extend over each of its sides have a variable length.

the beam has two parallel elements rigidly connected together by at least one cross member, each carrying a plurality of arms extending outward from one side only;

the beam is mounted on a foundation defining a support surface of the same order of magnitude as that of the base;

The bed base according to the invention thus comprises a succession of slats or group of slats whose ends, which are totally independent of each other, no longer rest and no longer are fastened on a rigid frame, but are held by the end of arms. By their flexibility the latter can flex under the weight of a person.

The slats or group of slats constituting the bed base can then bend independently of each other, pivot on themselves through the flexibility of the swivel joints and thus ensure the flexibility of the bed base, not only near its axis of symmetry, but also at the lateral ends.

Evidently the invention is not limited to bed bases with wooden slats but extends also to bed bases with metallic surfaces, the slats being replaced by netting of comparable width, and the lower slats by plates, rods or the like.

BRIEF DESCRIPTION OF DRAWINGS

To understand the invention better there is shown in the annexed drawing a non-limiting example of realization of a bed base according to the invention in which:

FIG. 1 is a schematic perspective view of the bed base,

FIG. 2 is a schematic perspective view of a slat-support unit according to the invention, FIG. 3 is a schematic transverse side view of the bed base according to the invention, FIG. 4 is a view in vertical section of a satellite.

DETAILED DESCRIPTION OF THE INVENTION

Figure 5:
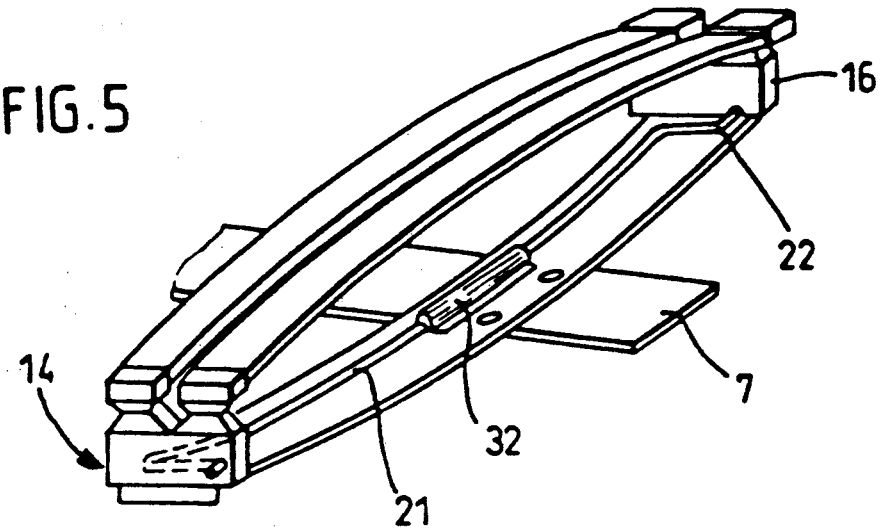
FIG. 5 is a perspective view of a unit equipped with a balancing torsion bar.

As is seen in FIGS. 1 to 6, the bed base 1 is of the type with slats, that is with longitudinal elements of semi-rigid surfaces; these elements are intended to receive a mattress and are generally arranged perpendicularly to the main axis 2 of the bed. The bed base rests on the floor by a stable and rigid mount constituting a fixed structure or member on which the slats are supported.

According to the invention, the slats 3 are mounted floating. The ends 4 no longer rest on a frame or similar conventional element which prevents all movement at the ends situated on one end and the same side. The slats are mounted on supports by having their ends connected to the ends 23 of arms 5, flexible like them, which are mounted by their other end on the structure 6, fixed relative to the floor.

As the slats 3 and support arms 5 are flexible, when a force is applied at the end 4 of a slat, the arms which supports it flexes with it downward by a height H, as shown in FIG. 3, opposing a certain resistance to the imposed force f. When the force disappears, the arm goes up again and simultaneously raises the slat to its initial position.

Figure 6:
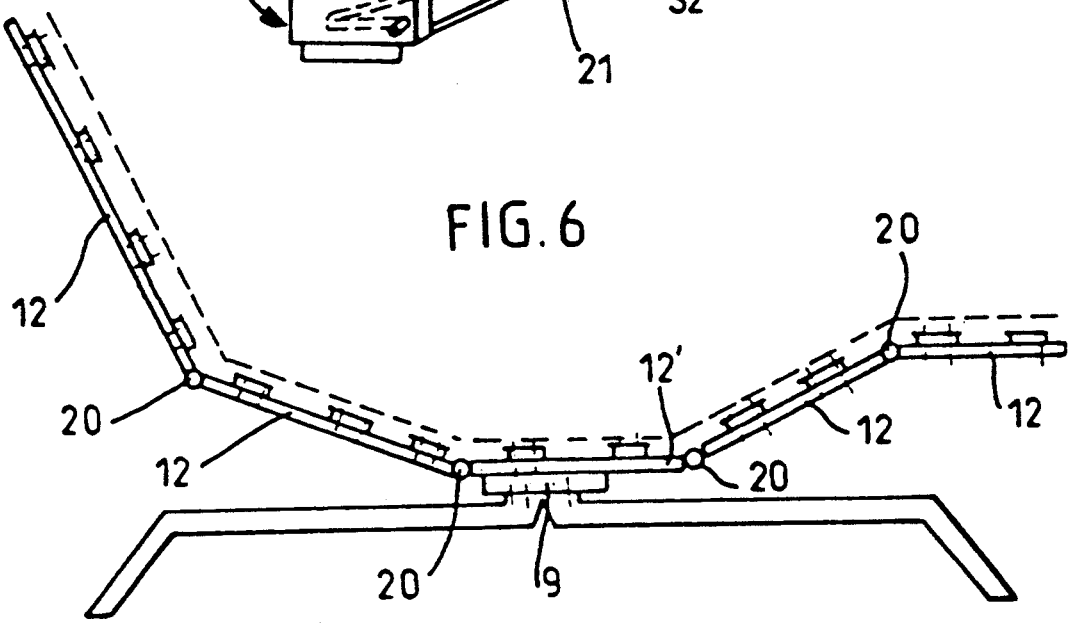
FIG. 6 is a schematic transverse side view of a variant of realization of a slatted bed base according to the invention.

According to the invention the fixed member or structure comprises at least one beam 7 which extends on the whole parallel to the longitudinal axis 2 of the bed base and over approximately its entire length between the two ends. The beam is mounted non-removably on the mount 8. In the example illustrated in FIG. 1, the beam 7 is in one rigid piece and mounted on two end cross-members 10 carrying the feet 11. In the embodiment of FIG. 6 the beam comprises several rigid parts 12 articulated around horizontal axes 20. One of the rigid parts 12' is mounted on a support 9 constituting the mount.

The beam 7 carries a plurality of flexible lower supports or arms 5, which extend on either side of its flanks. The arms 5 extend preferably perpendicularly to the axis 2 of the beam, but any other arrangement may be envisaged without going outside the scope of the invention.

In the first embodiment (FIGS. 1 to 5) the arms 5 are fastened to the ends 4 of the slats 3.

The bed base has juxtaposed, independent units or nodules 13, each comprising:

- at least one upper slat 3 (two in the example of FIG. 2) and at least one lower arm 5 traversing the bed base over its entire width.
- two linking elements or linking satellites 14, one at each end 4 of the slats, intended to assemble the lower slat or slats to the upper slat or slats.

The connection between the end of an arm 5 and the slat 3 is flexible. It is in fact necessary that this connection will not oppose the coming together of the slat and of the arm which takes place upon flexure. To this end each satellite 14 has a ferrule 15 (FIG. 4) or swivel joint, of rubber, intended to receive the end of the upper or lower slats, or of all slats. However, to let the connection keep a firm hold, it is provided to mount the end of the lower slats 5 without play or flexibility (by screwing or other means) on a solid piece 16, the flexible swivel joints being mounted, for example, on the upper side of said solid piece as the figures show.

The swivel joints 15 have mainly two functions. The first is to allow a certain torsion of the element it receives (slat or arm) around its longitudinal axis as FIG. 4 illustrates, arrow f. The second is to allow the longitudinal relative movements of the ends of the elements, slats and arms, during the bending. The slats slide relative to each other. The semi-rigid mounting of the satellite with the solid piece interposed between the lower and upper slats permits also using the torsional flexibility of the unit, as the arrow F indicates.

The units 13 are preferably arranged on the beam 7 approximately at their center and perpendicularly. The beam then forms the axis of symmetry of the bed base.

The units 13 are preferably also uniformly distributed along the beam, but it is possible to provide on the contrary an irregular distribution, for example closer together at the levels sustaining greater stresses. It is further possible to use units of variable characteristics (surface of the slats, intervals, resistances, etc.) with constant intervals between units.

The lower slat 5 is mounted on beam 7 in such a way that the unit is carried by the beam in a practically non-removable manner, (excepting disassembly). The mounting is rigid and without play. The portion of slat 17 applied on the beam 7 is immobile regardless of what stresses are applied on the upper slats, that is to say on the bed base. This arrangement is important because it, without any additional device, ensures the general stability of the bed base when a stress is applied at the end 4 of one or several slats.

On the other hand, the stability is ensured by the supporting surface of the mount. The spacing of the legs 11 will preferably be determined so that the support surface corresponds to that of the bed base, notably in the case of a bed for one person.

As is seen, the bed base according to the invention thus has a succession of upper slats 3 assembled in pairs per independent units 13, resting on a single lower beam 7, at which they are held. The upper slats are shown arched upward but they can just as well be straight, the flexibility of the linking elements 14 permitting the movements of the ends of slats inwardly as well as outwardly. The units are deformable by the flexibility of the upper and lower slats and this deformability ensures a supple vertical movement over the entire length of the unit, that is to say including at the ends 4.

The bed base can show numerous variants of realization without going outside the scope of the invention. For example:

1. The unit may comprise different numbers of slats, both upper 3 and lower 5, for example one upper slat to one lower, two to two, three to one or two, etc.

2. The upper slats have a stiffening device in the form of a counter-slat 18 arranged on their lower face and held by two sliding rings 19 (FIG. 3). When the rings 19 are brought together toward the center of the slat, the contact of the counter-slat on the slat extends over a small surface portion and there is little stiffening. When the rings are spaced apart, the contact of the counter-slat on the slat extends over a large surface portion: the stiffening increases.

Figure 9:
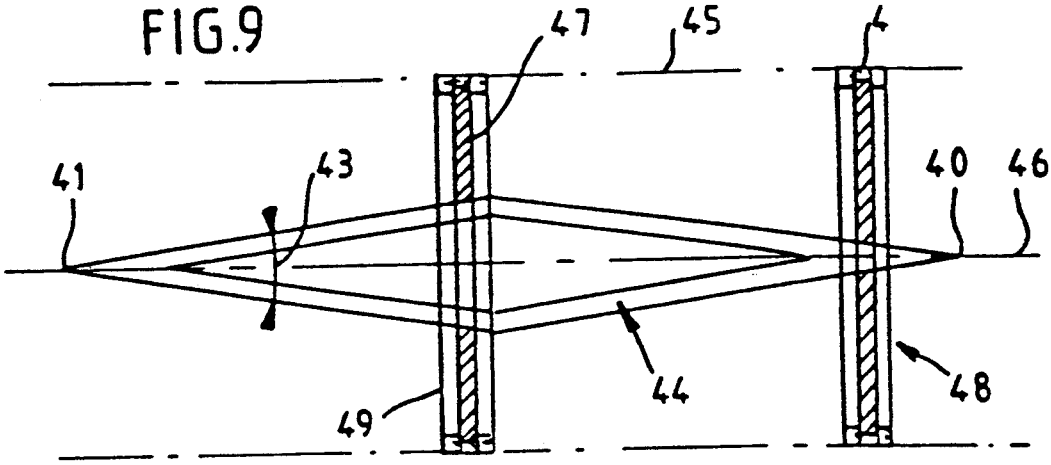
FIG. 9 is a schematic view from above of a variant of beam of the bed base according to the invention.

3. The variant of FIG. 9 illustrates a device for stiffening the support arms. The beam, which extends between the two longitudinal ends 40, 41, is of unequal width. It has, for example, the form of a narrow lozenge, consisting of four half-beams 44 assembled by welding or other means. The end 23 of the arms describes a straight edge 45, parallel to the axis of the beam. The arms then have a carrying length 47, and consequently a variable flexibility, which are maximum at the narrowest point of the beam, minimum at the point of the widest beam. In the example, the flexibility of the bed base diminishes from the head 48 toward the center 49.

Figure 10:
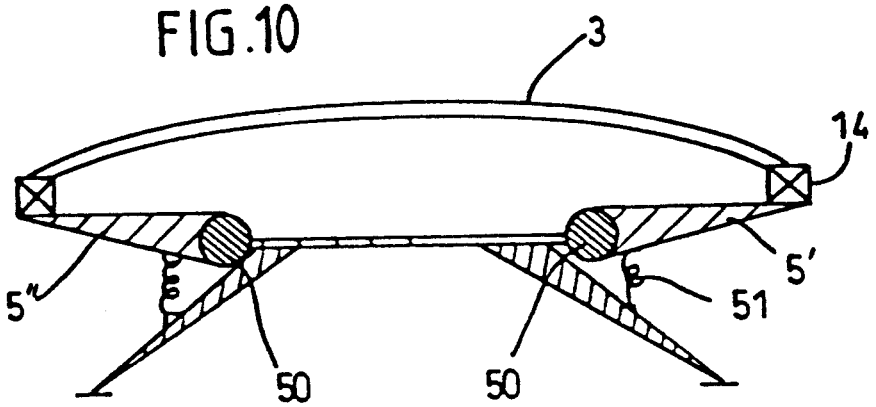
FIG. 10 is a schematic side view of a fourth embodiment of the bed base according to the invention.

4. The lower support may be formed of two separate rigid and undeformable arms 5', 5'', mounted pivoting on the beam around a horizontal axis 50 (FIG. 10). A spring 51 or any other equivalent device is mounted between the beam 7 (or the mount 8') and the arm to hold the arm against the slat and to obtain the flexibility of the assembly.

5. The beam may be formed of several rigid parts 12, 12', articulated around horizontal axes 20 (FIG. 6). One of the rigid parts is mounted on a support 9 forming the mount. This variant permits folding the bed, to obtain a bed convertible into a couch, etc.

6. It is possible to provide on the slat or lower arms 5 a torsion bar 21, as shown in FIG. 5. In fact, according to the invention a force applied to the end of a unit displaces the latter downward by a height H. Simultaneously, the opposite end moves slightly downward by a height h. It is possible to force this opposite end to move by an equivalent height H, to obtain a bed base constantly in horizontal equilibrium by arranging a bar 21 whose ends 22 are in engagement with the end pieces 16 of the linking element. The bar 4 is bent in U form, retained but freely pivoting on the beam in a sheath 32. When a satellite 14 moves downward, the bar pivots and this torsion is transmitted to the other end 4 thereby forcing said end to move downward also. In the figure the sheath is arranged on the lower slat, but it is possible to mount it on the beam and this permits having longer lever arms available.

Figure 8:
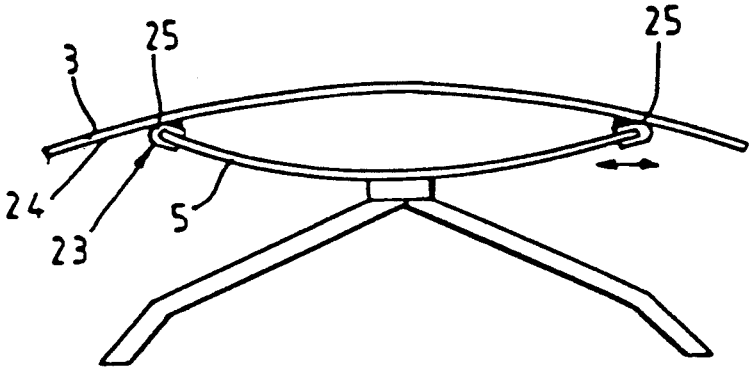
FIG. 8 is a schematic side view of a third embodiment of the bed base according to the invention.

7. It is possible to provide support arms or a lower slat 5 less long than the upper slat or slats 3. In this variant shown in FIG. 8 the ends 23 of the lower slat take support on the lower surface 24 of the upper slat. Said ends are mounted in a flexible ferrule 25, itself fastened on the upper slat, the flexibility of the ferrule allowing the movements of the two slats when bending. It is provided further to mount at the ends of the lower slat a linking element with swivel joint, as before, but the part receiving the upper slat or slats is made sliding by any means (clips, collars, etc.) on the upper slat or slats. This variant contributes furthermore to the control of the stiffening in that the arms 5 can be of variable length and consequently of relatively variable flexibility.

8. In the case of a double bed, it is made up of two identical elementary bed bases 1, arranged parallel in known manner. As a variant further the following arrangement is provided: each comprises a beam 7 but which can preferably be offset toward the center of the bed relative to the axis of symmetry 2 of its respective bed base. In this case the arms 5 do not have the same dimension on either side of the beam. This arrangement permits controlling the overall flexibility of the bed base when two persons are stretched out.

Figure 7:
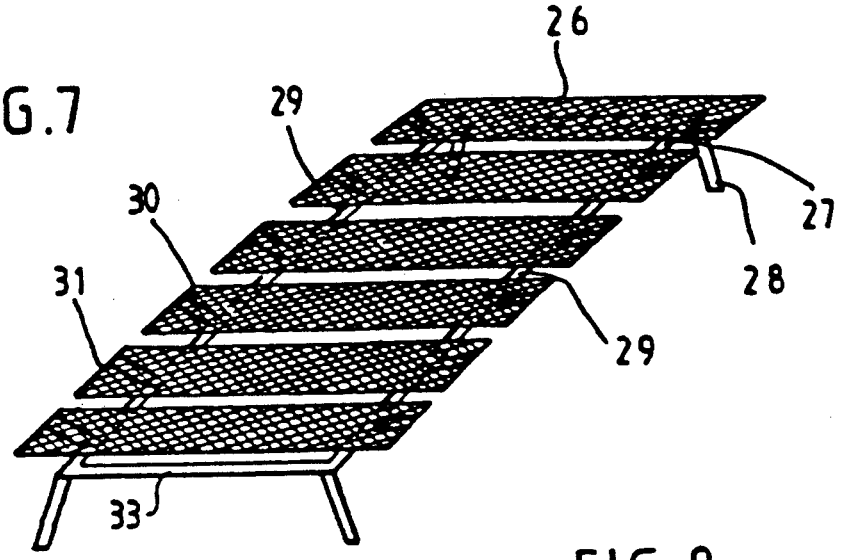
FIG. 7 is a perspective view of a second embodiment of a bed base according to the invention.

9. The invention covers also bed bases made up, not of slats 3 but of those 26 of wire gauze or netting, as FIG. 7 illustrates. In this variant the fixed structure comprises a rigid frame 27 resting on four legs 28 in conventional manner. In this case the bed base comprises two beams 29, consisting of the two longitudinal sides of the frame and connected by a pair of cross members 33. Each of the beams carries a plurality of arms 30 which extend on one side only, the outer side. The arms 30 are flexible, they are rods, plates or the like. At their end 31 there are hooks or equivalents over which the breadths are spread.

Naturally these different variants are not limitative and notably can be combined with one another without going outside the scope of the invention.

Lastly, the invention can be carried out with different surface elements of the slats as well as of the spread breadths of gauze, notably by the use of elements made of composite materials.

We claim:

1. A slatted bed base comprising:
a longitudinally extending central member,
a plurality of individual units, each unit comprising;
at least one flexible upper slat and at least one flexible lower support member;
flexible linking means for coupling the said at least one flexible upper slat to said at least one flexible lower support member,
means for mounting the said at least one lower support member of each of said individual units to said central member with the said at least one upper slat, lower support member and flexible linking means of each unit being independent of those of any other said unit.

2. Bed base according to claim 1 in which the linking means comprises an undeformable rigid piece on which is mounted a ferrule or swivel joint to receive and slidingly hold the said at least one upper slat and under which the end of said at least one lower support is fastened.

3. Bed base according to claim 2 wherein said at least one lower support member has an arm which is shorter than that of the said at least one upper slat and the ferrule of the linking means forms sliding means intended to receive and hold an upper slat while allowing the relative displacement of the slat on the lower support arm.

4. Bed base according to claim 1 wherein said at least one lower support member comprises opposing arms which extend laterally.

5. Bed base according to claim 4 wherein the lower support member comprises two undeformable rigid arms pivotally mounted on said central member along a horizontal axis and a spring acting against a fixed member and each said arm which raises the arm upward.

6. Bed base according to claim 4 wherein the central member is of variable width, and the end of each of the arms describes a straight edge such that the arms extending over each of the sides of the central member has a variable length.

7. Bed base according to claim 4 wherein said central member comprises two parallel elements rigidly connected to one another by at least one cross member, each said cross member carrying a plurality of said arms extending outwardly on one side only.

8. The bed base according to claim 7 wherein each unit comprises several identical upper slats coupled to one lower support arm.

9. Bed base according to claim 8 in which the linking means comprises an undeformable rigid piece on which is mounted a ferrule or swivel joint to receive and slidingly hold the upper slats and under which the end of said at least one lower support is fastened.

10. Bed base according to claim 8 wherein a said at least one lower support arm comprises opposing arms which extend laterally.

11. Bed base according to claim 8 wherein a said at least one upper slat is a wire gauze or netting.

12. Bed base according to claim 1 wherein said at least one upper slat is a wire gauze or netting.

* * * * *